US006307473B1

(12) United States Patent
Zampini et al.

(10) Patent No.: US 6,307,473 B1
(45) Date of Patent: Oct. 23, 2001

(54) ELECTRONIC ARTICLE SURVEILLANCE TRANSMITTER CONTROL USING TARGET RANGE

(75) Inventors: Michael A. Zampini; John W. Taylor, both of Boca Raton, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 09/382,066

(22) Filed: Aug. 24, 1999

(51) Int. Cl.[7] ..... G08B 13/14

(52) U.S. Cl. ..... 340/572.1; 340/572.2; 340/572.4; 340/10.1; 340/541; 340/525.49; 342/114

(58) Field of Search ..... 340/572.1, 572.3, 340/572.4, 10.1, 572.2, 541, 572.7, 825.49; 342/42, 114

(56) References Cited

U.S. PATENT DOCUMENTS

| | | | | |
|---|---|---|---|---|
| 4,510,489 | | 4/1985 | Anderson et al. | 340/572.1 |
| 4,595,915 | * | 6/1986 | Close | 340/572.2 |
| 5,030,941 | * | 7/1991 | Lizzi et al. | 340/541 |
| 5,661,457 | | 8/1997 | Ghaffari et al. | 340/572.7 |
| 6,034,604 | | 3/2000 | Kaltner | 340/572.3 |
| 6,084,512 | * | 7/2000 | Elberty et al. | 340/572.1 |
| 6,204,765 | * | 3/2001 | Brady et al. | 340/572.1 |

FOREIGN PATENT DOCUMENTS

| | | | |
|---|---|---|---|
| 2744317 | 5/1979 | (DE) | G01S/9/00 |

* cited by examiner

*Primary Examiner*—Benjamin C. Lee
(74) *Attorney, Agent, or Firm*—Rick F. Comoglio; Paul T. Kashimba

(57) ABSTRACT

An electronic article surveillance system responsive to the distance to a target within an interrogation zone is provided. The interrogation zone is defined by an electromagnetic field generated with a known level and transmitted by at least one antenna. A target within the interrogation zone can be any object, such as a person or shopping cart, within the interrogation zone. The target may include an EAS marker securable to an article for passage through the interrogation zone. The EAS marker is detectable at a frequency when in the electromagnetic field, and is detected by EAS detection equipment, as known in the art. The target within the interrogation zone is detected, and the distance from the antenna to the target is measured. The level of the electromagnetic field is controlled according to the distance to the target within the interrogation zone. The output level is adjusted to according to the distance to the target. The EAS system can include multiple antennas each producing an electromagnetic field that in combination define the interrogation zone. A ranging transducer is mounted near each antenna, or at opposing ends of the interrogation zone to measure the distance to a target within the interrogation zone. The output level of each electromagnetic field transmitted by each antenna can be individually controlled according to the distance from that antenna to the target. Multiple targets can be detected, and the power level of each electromagnetic field is adjusted accordingly. The electromagnetic field can be switched off and on by detection of the target in the interrogation zone. The direction of motion of the target can also be detected and used as a factor in alarm activation decisions.

13 Claims, 6 Drawing Sheets

ELECTRONIC ARTICLE SURVEILLANCE TRANSMITTER CONTROL USING TARGET RANGE

CROSS REFERENCES TO RELATED APPLICATIONS

N/A

STATEMENT REGARDING FEDERALLY SPONSORED RESEARCH OR DEVELOPMENT

N/A

BACKGROUND OF THE INVENTION

1. Field of the Invention

This invention relates to electronic article surveillance (EAS) systems, and more particularly to controlling the output power of an EAS transmitter using target range in an EAS interrogation zone.

2. Description of the Related Art

EAS systems are well known and are primarily used as a theft deterrent in retail establishments. U.S. Pat. No. 4,510,489 discloses one example of an EAS system that utilizes a marker adapted to resonate at a particular frequency provided by an incident magnetic field applied in an interrogation zone. One or more interrogation coils or antennas transmit the magnetic field, which defines the interrogation zone. Typically, antennas will be positioned at a store's exits to provide an interrogation zone through which customers must pass to exit the store. An active marker resonating in an interrogation zone is detected by EAS receive antennas and electronics, which can then trigger an alarm and/or result in other appropriate action. EAS systems detect the presence of an active marker anywhere in the interrogation zone. It would be advantageous, especially in applications involving very wide exits of 6 feet or wider, to determine where in the interrogation zone an active marker is located. The location of an active marker can aide in the identification of a potential shoplifter.

Presently, EAS interrogation antennas transmit at full power at all times to determine the presence of a marker. When an EAS marker is close to an antenna, full power is not necessary for detection, and needlessly causes excess power consumption. Constant operation at full power can also serve to reduce the long-term reliability of system components, causing increased service calls and failure rates. A marker placed outside, but close to the interrogation zone can, in certain circumstances, cause unintended alarms. An unintended alarm is an alarm that is due to the unintended detection of an active marker. Store personnel often display merchandise, with EAS markers attached, near store exits in the fringes of the intended interrogation zone that can sometimes cause unintended detection of the attached markers. The proximity of the EAS markers to the intended interrogation zone may cause an increased incidence of unintended alarms. Unintended alarms can result in an increased number of service calls, which unnecessarily increases the overall system operating expense. Detection of an active marker combined with detection of a target in the interrogation zone could eliminate the incidence of unintended alarms caused by markers being detected in areas adjacent to the intended interrogation zone. "Target" as used herein refers to people or other moving objects such as shopping carts capable of transporting an EAS marker into an interrogation zone.

In an attempt to solve some of the above mentioned problems, infrared beams and passive infrared (PIR) motion detectors have been used to detect people or other moving targets in the interrogation zone. In operation, if a marker is detected and there was no motion in the interrogation zone, then the detection was probably unintended. However, PIR detection zones often extended beyond the interrogation zone and result in detected motion when no one was actually in the interrogation zone. To try and control the PIR detection zone, freznel lenses were utilized that were difficult to set and control resulting in an expensive and less than ideal solution. Infrared detection of targets does not provide the capability, other than on/off control, of controlling transmitter power levels because only the presence or lack of presence of a target is detected. When transmitted, the interrogation electromagnetic field of present EAS systems is transmitted at full power.

What is needed is a solution to the problems discussed hereinabove, which includes transmitter power level control resulting in reduced incidence of unintended alarms, improved reliability, and reduced system operating and service costs.

BRIEF SUMMARY OF THE INVENTION

The present invention provides an electronic article surveillance system responsive to the distance to a target within an interrogation zone. The interrogation zone is defined by an electromagnetic field generated with a known output level and transmitted by at least one antenna. A target within the interrogation zone can be any object, such as a person or shopping cart, within the interrogation zone. The target may include an EAS marker securable to an article for passage through the interrogation zone. The EAS marker is adapted to be detectable at a selected frequency when in the interrogation electromagnetic field. The marker is detected by EAS detection equipment at the selected frequency, as known in the art. The target within the interrogation zone is detected, and the distance from the antenna to the target is measured. The output level of the electromagnetic field is controlled according to the distance to the target within the interrogation zone. The output level is adjusted to be proportional to the distance to the target. If the target is near to the antenna, the output level will be adjusted relatively low, and if the target is far from the antenna, the output level will be adjusted relatively high.

To measure the distance between the EAS antenna and the target within the interrogation zone, an ultrasonic ranging system can be utilized. Ultrasonic ranging equipment includes an ultrasonic transducer and associated ultrasonic ranging electronics. The ultrasonic transducer is mounted on or near the EAS antenna. The ultrasonic system measures distance by transmitting a burst of energy at ultrasonic frequencies from the ultrasonic transducer. The transmitted ultrasonic energy impinges upon the target and is reflected back to the transducer. The distance from the transducer to the target is derived from the round trip travel time of the ultrasonic energy.

Alternately, a microwave radar motion sensor can be utilized to determine the distance between the EAS antenna and the target within the interrogation zone. With microwave radar motion sensors, range is determined from the amplitude of a microwave transmission reflected back from the target. A microwave transducer is mounted on or near the EAS antenna in similar manner to the ultrasonic transducer described above.

In addition to ultrasonic and radar ranging systems, other ranging systems can be utilized such as laser ranging. Laser ranging requires the use of a scanning mirror, lens assembly, or other beam-spreading device to be implemented because of the narrow beam of the laser. Therefore, ultrasonic and radar ranging systems are preferred.

An LAS system often includes multiple antennas. The resultant interrogation zone will be defined by the combination of each electromagnetic field associated with each antenna. A transducer from a selected ranging system (ultrasonic, radar, or other suitable ranging system) is mounted on or near each antenna to measure the distance from that antenna to a target within the interrogation zone. The output level of each electromagnetic field transmitted by each antenna can be individually controlled according to the distance from that antenna to the target. Alternately, a ranging transducer is mounted on or near each opposing end of the interrogation zone to measure the distance to a target within the interrogation zone. The measured distance from the ranging transducers to the target can be utilized to detect multiple targets within the interrogation zone. The power output level of each electromagnetic field is controlled accordingly.

Accordingly, it is an object of the present invention to provide an EAS interrogation electromagnetic field with the output level selected according to the distance to a target within the EAS interrogation zone.

It is a further object of the present invention to provide power consumption savings for operation of an EAS system by controlling the power output level of the EAS interrogation electromagnetic field according to the distance to a target in the EAS interrogation zone.

It is still a further object of the present invention to provide improved reliability of EAS system components by controlling the output power level of the EAS interrogation electromagnetic field according to the distance to a target in the EAS interrogation zone.

It is yet a further object of the present invention to provide an EAS system which measures the distance to a target from opposite ends of an interrogation zone to determine if there are multiple targets simultaneously being detected in the interrogation zone, and adjusts the power output level of the interrogation electromagnetic field accordingly.

Other objectives, advantages, and applications of the present invention will be made apparent by the following detailed description of the preferred embodiment of the invention.

DETAILED DESCRIPTION OF THE INVENTION

Figure 1:
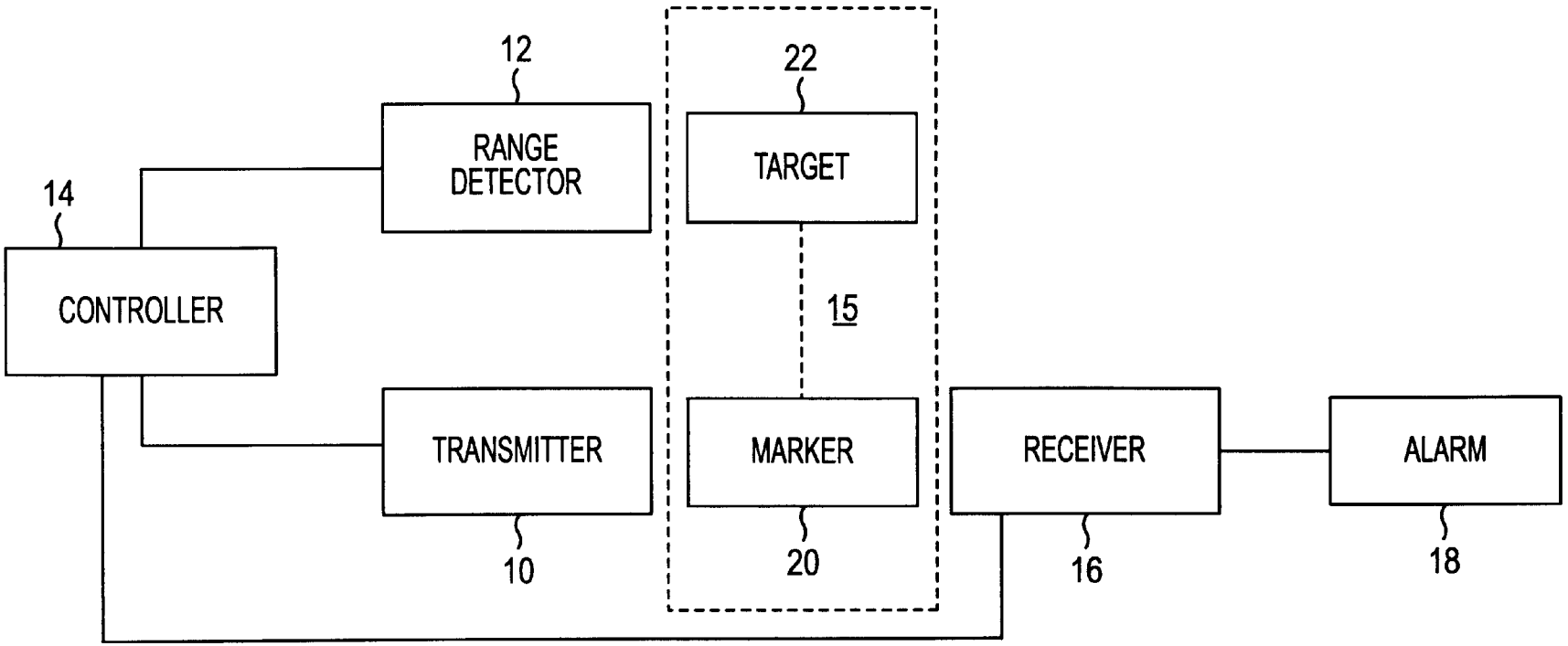
FIG. 1 is a block diagram of the present invention.

Referring to FIG. 1, the present invention is shown comprising EAS transmitter 10 and range detector 12 connected to controller 14, which is preferably a microprocessor. EAS receiver 16 is connected to alarm 18. Marker 20 and target 22 are shown in interrogation zone 15. Target 22, which may pass through interrogation zone 15 without being associated with an active marker 20, is illustrated connected to marker 20 by a dotted line. In operation, transmitter 10 generates an electromagnetic field that is an interrogation electromagnetic field that substantially defines interrogation zone 15. Controller 14, as described hereinbelow, controls the output power level of the electromagnetic field generated by transmitter 10. Marker 20 is adapted to resonate at a particular frequency when exposed to the electromagnetic field generated by transmitter 10. Receiver 16 detects the resonance of marker 20 and sends a signal to alarm 18, which can be any type of indicator as known in the art. Transmitter 10, marker 20, receiver 16 and alarm 18 are well known in the art. One example of suitable EAS components is illustrated in U.S. Pat. No. 4,510,489, the disclosure of which is incorporated herein by reference.

For range detection using ultrasonic technology, range detector 12 generates a ranging pulse that impinges upon target 22 within interrogation zone 15. Target 22 is normally a person, but can be any other moving object such as a shopping cart. Target 22 may be carrying an article of merchandise to which marker 20 is attached. The ranging pulse is reflected off of target 22 back to detector 12, which measures the time for the transmitted ranging pulse to travel round trip, as further described hereinbelow. Controller 14 uses the round trip travel time of the ranging pulse to calculate the distance to target 22 and uses that distance to determine the desired output power level for transmitter 10. A suitable ultrasonic range detector is available from the Polaroid Company and is identified by product code number 604142. An alternate source for an ultrasonic range detector is available from Murta Erie and is identified under the name MA40 series.

Figure 2:
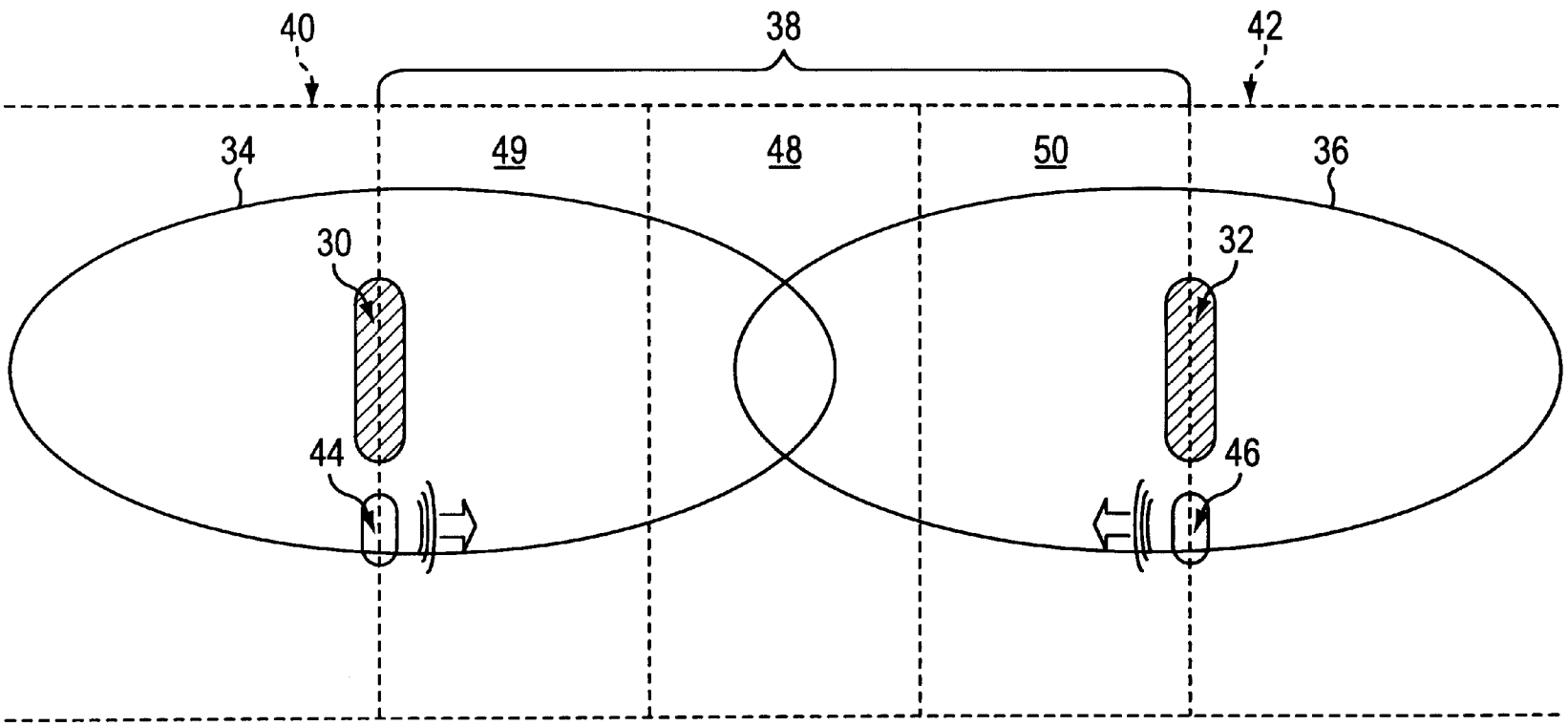
FIG. 2 is a block diagram illustrating a typical placement of antennas and the interrogation zone of the present invention.

Referring to FIG. 2, one embodiment of the present invention is illustrated including EAS antennas, 30 and 32, which transmit electromagnetic fields 34 and 36, respectively. Two antennas 30 and 32 are illustrated as many EAS systems utilize two antennas, however, systems having a single antenna or three or more antennas are contemplated herein. Antennas 30 and 32 are each connected to one or more receivers 16, for detecting an active marker 20. One or more transmitters 10, shown in FIG. 1, generate electromagnetic fields 34 and 36 that are transmitted by antennas 30 and 32, respectively. In FIG. 2, it should be understood that the extent of electromagnetic fields 34 and 36 are dependent upon the power output level of transmitter 10. Electromagnetic fields 34 and 36 substantially define interrogation zone 38. Interrogation zone 15, illustrated in FIG. 1, is equivalent to interrogation zone 38 for the embodiment illustrated in FIG. 2. Electromagnetic fields 34 and 36 also define interrogation zones 40 and 42, respectively. As further discussed hereinbelow, interrogation zones 40 and 42 may be unintended interrogation zones of antennas 30 and 32.

Ranging transducer 44 is mounted on or near antenna 30, and ranging transducer 46 is mounted on or near antenna 32. Ranging transducers 44 and 46 are adjusted to cover the interrogation zone 38. A ranging detector 12, shown in FIG. 1, generates ranging pulses that are transmitted by ranging transducers 44 and 46. Alternately, a separate ranging detector 12 can be connected to each transducer 44 and 46. If a target 22 is present in interrogation zone 38, the ranging pulses will impinge upon target 22 and be reflected back to transducer 44 and 46. The pulses are timed so that if a target 22 is not present in interrogation zone 38, transducer 46 (or 44) will not falsely detect pulses transmitted by transducer 44 (or 46). Time is counted within detector 12 for each ranging pulse from the time a pulse is transmitted by either ranging transducer 44 or 46, until it is reflected by a target 22, and returns to the transmitting transducer to be detected by detector 12. Controller 14 uses the counted round trip travel time of the ranging pulses to calculate the distance between target 22 and ranging transducers 44 and 46.

Antennas 30 and 32 are typically placed at the outer edges of a store exit, such that people must pass through interrogation zone 38 in order to exit the store. In such an arrangement, interrogation zones 40 and 42 will be unintended interrogation zones and can result in unintended alarms by markers 20 inadvertently being placed within either of those zones. To essentially eliminate unintended alarms associated with unintended interrogation zones 40 and 42, detection, within interrogation zone 38, of target 22, by ranging transducers 44 and 46 and range detector 12, can be required before alarm 18 is activated by receiver 16. If a marker 20 is detected within electromagnetic field 34 or 36, but no target 22 is detected within interrogation zone 38, the detection of marker 20 is determined to be an active marker 20 in an unintended interrogation zone 40 or 42. Controller 14 will command receiver 16 not to generate a detection alarm 18, but to alert appropriate store personnel so that corrective action can be taken. An unintended alarm will be an indication that is distinguishable from a normal detection alarm generated when a marker 20 is detected within interrogation zone 38.

When a target 22 (shown in FIG. 1) is detected within interrogation zone 38 by ranging detector 12 and ranging transducers 44 and 46, the distance from target 22 to ranging transducers 44 and 46 is calculated by controller 14. The distance calculated by controller 14 from the target 22 to ranging transducers 44 and 46 will be equivalent to the distance from target 22 to antenna 30 and 32, respectively, because ranging transducers 44 and 46 are mounted on or near antennas 30 and 32, respectively. Controller 14, according to the distances calculated to target 22, will appropriately adjust the output power level of transmitter 10.

For example, if target 22 is detected within central area 48, full power will be transmitted from antennas 30 and 32. If target 22 is detected within area 49, the power level associated with electromagnetic field 34 will be reduced, and electromagnetic field 36 will be tuned off. If target 22 is detected within area 50, the power level associated with electromagnetic field 36 will be reduced, and electromagnetic field 34 will be turned off. The determination of the proper power level associated with electromagnetic field 34 and 36 will depend upon primarily two parameters, the first of which being the distance to target 22 from antenna 30 and 32, respectively. Secondly, the output power level must be sufficient such that a marker 20, which can be associated with an article carried by target 22 within interrogation zone 38, will be in an electromagnetic field strong enough for detection of marker 20 by receiver 16. Controller 14 can also simply turn on full output power when a target is anywhere within interrogation zone 38, and turn the output power off when there is no target within interrogation zone 38.

Figure 3:
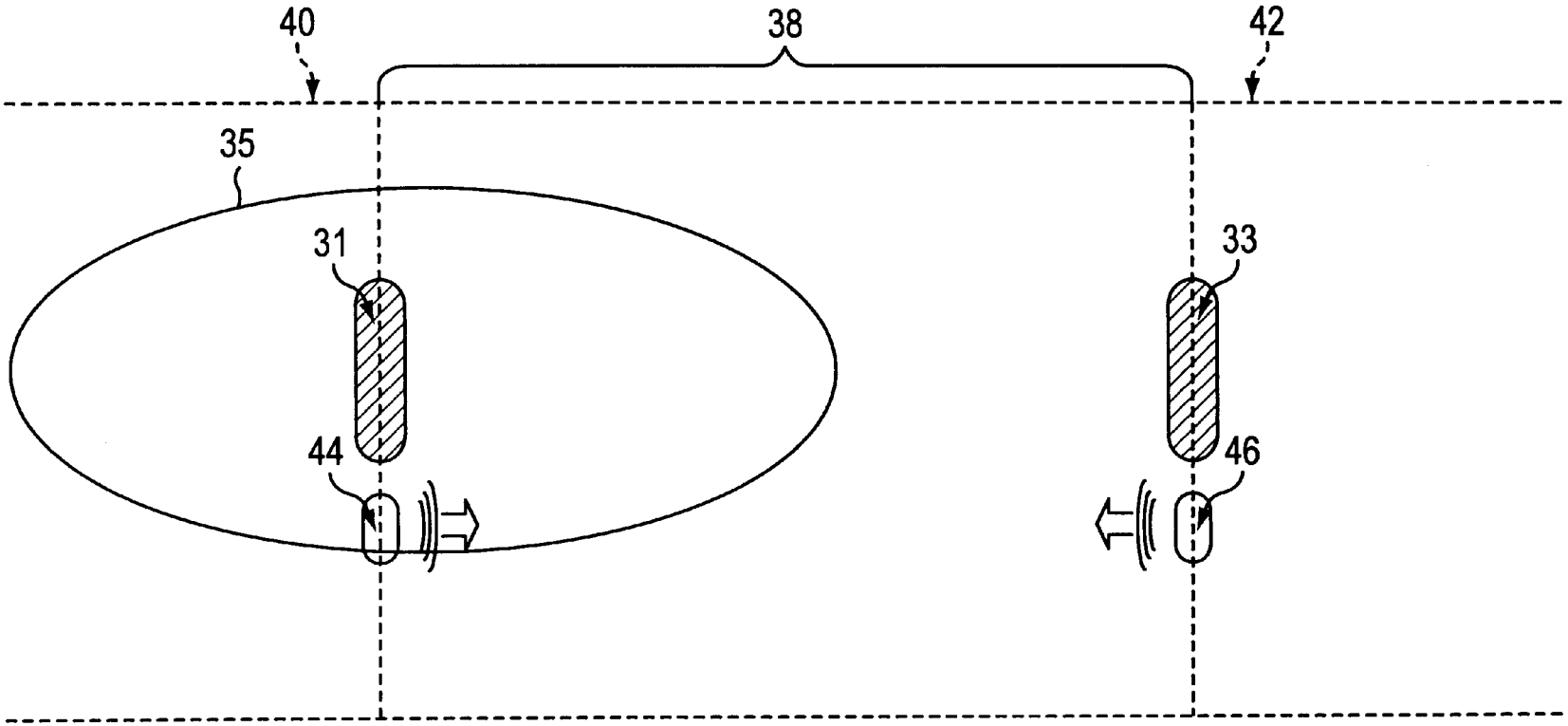
FIG. 3 is a block diagram showing a second embodiment of that shown in FIG. 2.

Referring to FIG. 3, in a second embodiment, one of the antennas, 30 and 32, shown in FIG. 2, is configured to transmit only and the other antenna is configured to receive only. In FIG. 3, identical components to those shown in FIG. 2 have the same reference numerals, and the above discussion associated with like reference numerals applies to this embodiment. Antenna 31 transmits only and antenna 33 receives only. It should be understood that the extent of electromagnetic field 35 illustrated in FIG. 3 is dependent upon the power output level of transmitter 10. The output power level associated with electromagnetic field 35 will be controlled according to the distance calculated to target 22 from transducer 44, and the minimum output power level required to insure detection of marker 20 by receiver 16 at the detected distance within interrogation zone 38. Transducer 46 can also be utilized to determine the distance to target 22. While both are illustrated in FIG. 3, the distance to target 22 can be determined using only one transducer, 44 or 46.

Figure 4:
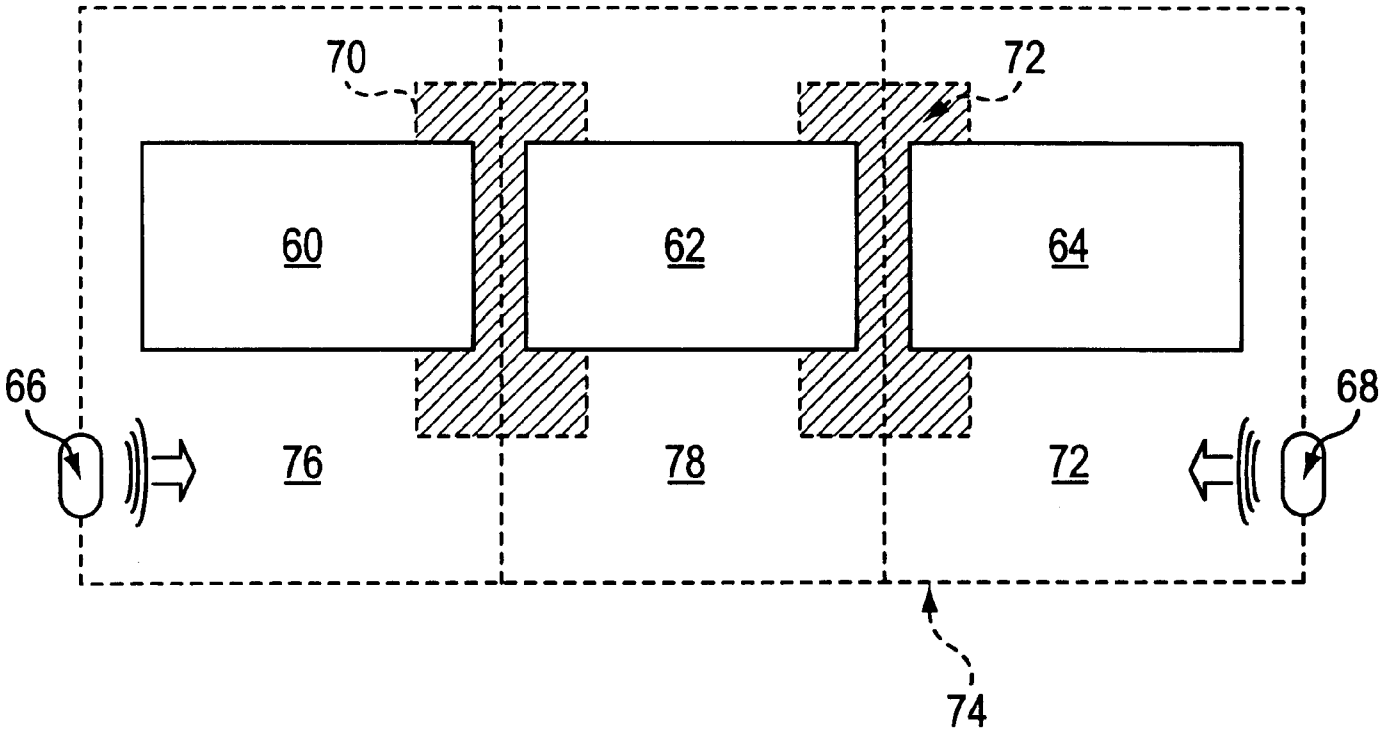
FIG. 4 is a block diagram illustrating an alternate embodiment for the antennas and the interrogation zone of the present invention.

Referring to FIG. 4, an embodiment of the invention is illustrated for an EAS system having floor or ceiling mounted antennas 60, 62, and 64. Ranging transducers 66 and 68 are identical to transducers 44 and 46 discussed hereinabove. Floor or ceiling mounted antennas are typically used to cover very wide store exits. With floor or ceiling mounted antennas 60, 62, and 64, areas 70 and 72 represent areas of uncertainty as to which antenna 60 or 62, or 62 or 64, respectively, may have detected a marker 20. With wide exits it is often desirable to know where the marker 20 was detected in the interrogation zone so that an appropriate alarm can be activated. As described hereinabove, one or more controllers 14 will determine the distance to a target 22 within interrogation zone 74 from both transducers 66 and 68 to determine which of areas 76, 78, or 80 the target is detected. The distance from transducers 66 and 68 to target 22 will thus be known. When a marker 20 associated with target 22 is detected, the areas of uncertainty, 70 and 72, for the location of the detection of marker 20, are eliminated because the position of target 22 will be known from the distances to transducers 66 and 68. As described hereinabove for the embodiment illustrated in FIG. 2, the distance measurement to target 22 can be used to control the output power level associated with each antenna 60, 62, and 64.

In the embodiments illustrated hereinabove, if two or more targets 22 simultaneously pass through the interrogation zone (38 or 74), the distance calculated from transducer 44 and 46 (or 66 and 68) may be to different targets. When performing distance calculations, controller 14 is programmed with the known distance between transducers 44 and 46 (or 66 and 68), and with an assumed size for the expected target, which is normally a person. If the distance calculated for the target 22 from transducer 44 (or 66) and from transducer 46 (or 68), plus the size of the expected target, does not equal the distance between transducers 44 and 46 (or 66 and 68), controller 14 determines that there must be multiple targets 22 in the interrogation zone. The output power levels of the electromagnetic fields are adjusted accordingly. For example, in the embodiment illustrated in FIG. 2 where both antennas 30 and 32 transmit and receive, if a target 22 is detected in area 49 by the distance calculated from transducer 44, but simultaneously the distance calculated from transducer 46 indicates target 22 is in area 50, then multiple targets are indicated. The output power levels for antenna 30 and antenna 32 can thus be kept at maximum to be certain that a marker 20 anywhere within interrogation zone 38 is detected.

An alternate selection for ranging detector 12, is a microwave radar sensor, such as Siemens model KMY 24, sold by Infineon Technologies. As fully described hereinbelow, using a microwave radar sensor, the range to target 22 is determined differently than using the travel time of an ultrasonic pulse as described above. The preferred embodiment of the present invention, and selection of an ultrasonic detector or microwave radar sensor, depends on the EAS system. Ultrasonic detection is preferred in microwave EAS systems operating at 2.45 GHz, which is the frequency of operation of the model KMY 24, and which may cause interference. Microwave radar sensors are preferred in magnetomechanical EAS systems because the ultrasonic detector operates at about 50 KHz, which is near the frequency of operation of magnetomechanical EAS systems. However, ultrasonic detectors can operate during magnetomechanical EAS non-transmit periods and are useable.

Referring again to FIG. 1, for a microwave radar sensor, range detector 12 transmits a microwave signal, which is reflected by target 22. The amplitude change in the reflected signal, as compared to the transmitted signal, is detected by detector 12 and is supplied to controller 14, which uses the amplitude change to determine range to target 22. Once controller 14 calculates the range to target 22, control of the output power level of transmitter 10 proceeds as described hereinabove for ultrasonic range detection.

Range detector 12, using a microwave radar sensor such as model KMY 24, can be used to determine the direction of motion of a target 22 as well as range. If a target 22 is moving within interrogation zone 15, a Doppler effect or phase shift occurs in the transmitted microwave signal that is reflected off of target 22. The reflected microwave signal from target 22 is compared to the transmitted microwave signal and the detected phase shift is positive or negative depending on whether target 22 is receding or approaching. Controller 14 uses the phase shift information to determine whether target 22 is entering or leaving a store having an interrogation zone 15 at the entrance/exit. Detection of an active marker 20 along with a target 22 exiting the store causes the activation of alarm 18, which alerts appropriate store personnel that an article with an active marker 20 is being removed from the store.

EAS systems are generally concerned with customers leaving a store with articles of merchandise. In prior art EAS systems, if a customer tried to enter the store carrying an article having an active marker attached, when the active marker was detected in the interrogation zone an unintended alarm would be set off. In the present invention, if an active marker 20 is detected within the interrogation zone 15, and target 22 is detected entering the store, the detection of marker 20 is an unintended detection. Instead of setting off alarm 18, appropriate store personnel can be notified that the active marker 20 detected in interrogation zone 15 is an active marker 20 being carried into the store, and appropriate action can be taken.

Figure 5:
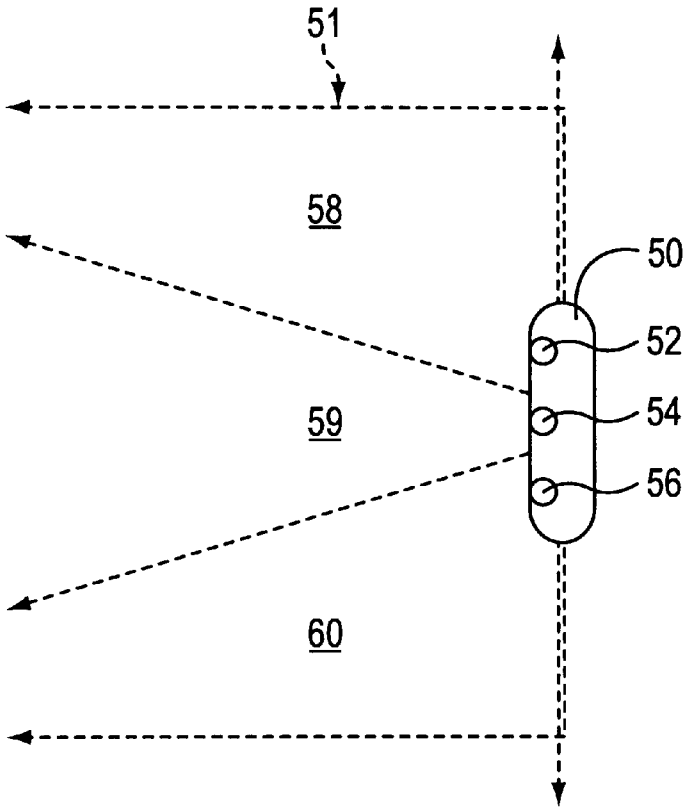
FIG. 5 is a block diagram of an embodiment for detecting target direction.

Referring to FIG. 5, direction of motion of a moving target 22, can be determined by controller 14 in the ultrasonic embodiment, described hereinabove, by using a plurality of ultrasonic transducers mounted on or near an antenna, or adjacent the intended interrogation zone. In the ultrasonic embodiment, ultrasonic transducers 52, 54, and 56 are mounted on or near antenna 50. Three ultrasonic transducers are illustrated, but two, four or more ultrasonic transducers can be implemented and are contemplated herein. Ultrasonic transducers 52, 54, and 56 are directed to ensonify regions 58, 59, and 60, respectively. Assuming region 58 is pointing within the store and region 60 is pointing out of the store, detection of target 22 in region 60 prior to detection in region 59 indicates a target entering the store. If an active marker 20 is detected within interrogation zone 51 along with detection of target 22 entering the store, detection of the marker 20 is unintended and appropriate store personnel can be notified that an active marker is being carried into the store.

Detection of a target 22 in region 60 but not in region 59, along with detection of an active marker 20 within interrogation zone 51, indicates that someone is carrying an active marker 20 past the entrance of the store, but not entering, and no action need be taken. Similarly, detection of a target 22 in region 58 but not in region 59, along with detection of an active marker 20 within interrogation zone 51, indicates that someone is carrying an active marker 20 past the exit of the store, but not exiting, and no action need be taken.

Figure 6:
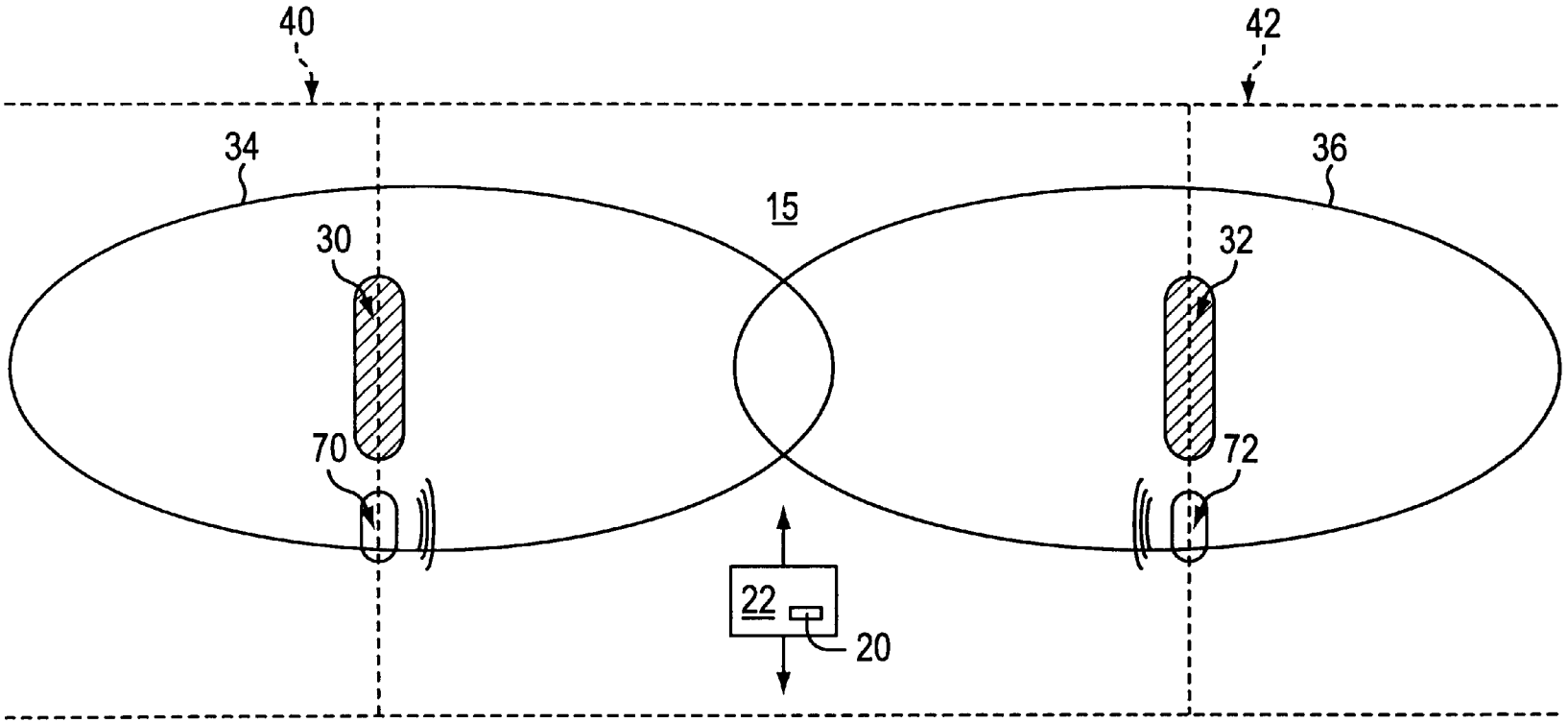
FIG. 6 is a block diagram of an embodiment of that shown in FIG. 5.

Referring to FIG. 6, using the microwave radar sensor embodiment described hereinabove direction information of target 22 is obtainable by controller 14 from a single microwave sensor mounted at each antenna, 70 and 72, or adjacent the intended interrogation zone. In the microwave embodiment, separate regions 58, 59, and 60 would not need to be defined, as a single sensor (70 or 72) can detect directional information directly from the Doppler shift of the signal reflected from target 22.

Directional information can further be used by controller 14 to monitor the total number of people that enter and exit a store. Prior systems could count the number of people that passed through an entrance or exit, but without direction information, there was no way to determine whether a counted person was entering or exiting, only that the person was passing through the entrance or exit.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the forgoing disclosure.

What is claimed is:

1. An electronic article surveillance system responsive to the distance to a target within an interrogation zone, comprising:

means for defining an interrogation zone, said means including an antenna;

means, connected to said antenna, for generating an electromagnetic field at a level;

a marker securable to an article for passage through said interrogation zone, said marker being adapted to be detectable when in said electromagnetic field;

detection means for detecting said marker;

means for measuring a distance from said antenna to a target within said interrogation zone; and, means for controlling the level of said electromagnetic field, wherein the level is selected according to the distance to said target.

2. The system of claim 1 wherein said means for measuring distance includes an ultrasonic transducer and ranging means associated with said ultrasonic transducer for measuring distance.

3. The system of claim 1 wherein there are a plurality of antennas, said generating means generates an electromagnetic field at a level associated with each of said plurality of antennas, said means for controlling including means for measuring the distance from each of said plurality of antennas to a target within said interrogation zone, wherein the level of said electromagnetic field associated with each of said plurality of antennas is selected according to the distance from each of said plurality of antennas to said target.

4. The system of claim 3 wherein said means for measuring distance includes a plurality of ultrasonic transducers and ranging means associated with said plurality of ultrasonic transducers for measuring distance.

5. The system of claim 1 wherein said means for measuring distance includes a microwave radar sensor and ranging means associated with said microwave radar sensor for measuring distance.

6. The system of claim 3 wherein said means for measuring distance includes a plurality of microwave radar sensors and ranging means associated with said plurality of microwave radar sensors for measuring distance.

7. A method of controlling the output level of an electronic article surveillance system, comprising the steps of;

providing an interrogation zone for detection of an EAS marker comprising generating and transmitting through at least one antenna, an electromagnetic field at a level;

detecting a target within said interrogation zone;

measuring the distance from said antenna to said target;

controlling the level of said electromagnetic field according to the distance measured.

8. The method of claim 7 further comprising the steps of:

measuring the distance from a plurality of antennas to said target;

controlling the level of an electromagnetic field associated with each antenna according to the distance measured from each of said plurality of antennas to said target.

9. An electronic article surveillance system responsive to the distance to a target within an interrogation zone, comprising:

means for defining an interrogation zone, said means including a plurality of antennas;

means, connected to said plurality of antennas, for generating an electromagnetic field at a level;

a marker securable to an article for passage through said interrogation zone, said marker being adapted to be detectable when in said electromagnetic field;

detection means for detecting said marker;

a first and a second transducer disposed adjacent said interrogation zone;

means for detecting a target within said interrogation zone, including means for measuring a distance from said first transducer to said target and from said second transducer to said target, wherein file location of the target within said interrogation zone is thereby known and the location of said marker detected by said detection means is determinable; and, means for controlling the level of said electromagnetic field, wherein the level is selected according to the distance from said first transducer to said target and from said second transducer to said target.

10. The system of claim 9 wherein said means for controlling the level of said electromagnetic field further determines, based upon the distance from said first transducer to said target and from said second transducer to said target and a preselected size of an expected target, that said means for detecting a target is simultaneously detecting a plurality of targets in said interrogation zone.

11. An electronic article surveillance system responsive to a target within an interrogation zone, comprising:

means for defining an interrogation zone, said means including a plurality of antennas;

means, connected to said plurality of antennas, for generating an electromagnetic field at a level;

a marker securable to an article for passage through said interrogation zone, said marker being adapted to be detectable when in said electromagnetic field;

detection means for detecting said marker;

a first and a second transducer disposed adjacent said interrogation zone;

means for detecting a target within said interrogation zone;

means for controlling said means for generating said electromagnetic field according to detection of said target within said interrogation zone, wherein said electromagnetic field is generated only when said target is detected; and, means for measuring a distance from said first transducer to said target and from said second transducer to said target; and, means for controlling the level of said electromagnetic field, wherein the level is selected according to the distance from at least one of said first and said second transducers to said target.

12. The system of claim 11 wherein said means for controlling the level of said electromagnetic field further determines, based upon the distance from said first transducer to said target and from said second transducer to said target and a preselected size of an expected target, when said means for detecting a target is simultaneously detecting a plurality of targets in said interrogation zone, wherein the level of said electromagnetic field is adjusted accordingly.

13. A method of controlling the output of an electronic article surveillance system, comprising the steps of:

providing an interrogation zone for detection of an EAS marker comprising generating and transmitting through at least one antenna, an electromagnetic field;

detecting a target wit said interrogation zone;

transmitting said electromagnetic field only when said target is detected within said interrogation zone;

determining the position of said target within said interrogation zone; and, controlling the level of said electromagnetic field wherein the level is selected according to the position of said target within said interrogation zone.

* * * * *

UNITED STATES PATENT AND TRADEMARK OFFICE

CERTIFICATE OF CORRECTION

PATENT NO. : 6,307,473 B1
DATED : October 23, 2001
INVENTOR(S) : Zampini et al.

It is certified that error appears in the above-identified patent and that said Letters Patent is hereby corrected as shown below:

Column 3,
Line 4, replace "LAS" with -- EAS --

Column 9,
Line 38, replace "file" with -- the --

Column 10,
Line 42, replace "wit" with -- within --

Signed and Sealed this

Twenty-sixth Day of March, 2002

*Attest:*

*Attesting Officer*

JAMES E. ROGAN
*Director of the United States Patent and Trademark Office*